US009846393B2

(12) United States Patent
Ohashi et al.

(10) Patent No.: US 9,846,393 B2
(45) Date of Patent: Dec. 19, 2017

(54) WASTE TONER COLLECTING DEVICE AND IMAGE FORMING APPARATUS INCLUDING THE SAME

(71) Applicant: KYOCERA Document Solutions Inc., Osaka (JP)

(72) Inventors: Hiroaki Ohashi, Osaka (JP); Masahiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/451,625

(22) Filed: Mar. 7, 2017

(65) Prior Publication Data

US 2017/0277079 A1 Sep. 28, 2017

(30) Foreign Application Priority Data

Mar. 25, 2016 (JP) ..... 2016-061371

(51) Int. Cl.
*G03G 21/10* (2006.01)
*G03G 15/095* (2006.01)
*G03G 15/08* (2006.01)

(52) U.S. Cl.
CPC ..... *G03G 15/095* (2013.01); *G03G 15/0891* (2013.01); *G03G 21/105* (2013.01)

(58) Field of Classification Search
CPC .. G03G 15/095; G03G 15/0891; G03G 21/10; G03G 21/105
See application file for complete search history.

(56) References Cited

U.S. PATENT DOCUMENTS

2012/0237268 A1* 9/2012 Sakashita ..... G03G 15/0189 399/258
2014/0076691 A1* 3/2014 Yamada ..... G03G 15/0189 198/548
2014/0294429 A1 10/2014 Inui et al.
2014/0294475 A1* 10/2014 Nishikawa ..... G03G 21/105 399/358
2015/0023708 A1* 1/2015 Lee ..... G03G 21/105 399/358
2016/0026119 A1* 1/2016 Ohashi ..... G03G 21/12 399/358
2017/0146946 A1* 5/2017 Ueno ..... G03G 21/10

FOREIGN PATENT DOCUMENTS

JP 2014-191341 A 10/2014

* cited by examiner

*Primary Examiner* — David M Gray
*Assistant Examiner* — Laura Roth
(74) *Attorney, Agent, or Firm* — Studebaker & Brackett PC

(57) ABSTRACT

A waste toner collecting device includes an intermediate collection box, a conveying path, a conveying screw, an exhaust path and a floating toner collection chamber. The conveying path is provided in the intermediate collection box. The conveying screw is rotatable in the conveying path. Through the exhaust path, air containing a floating toner is sucked and passed. The floating toner collection chamber is provided on a part of the exhaust path in the intermediate collection box. The floating toner collection chamber has a discharge opening opened to an inside of the intermediate collection box and a discharge door. Rotation of the conveying screw in a normal direction turns the discharge door into a storage position where the discharge opening is closed. Rotation of the conveying screw in a reverse direction turns the discharge door into a discharge position where the discharge opening is opened.

9 Claims, 12 Drawing Sheets

WASTE TONER COLLECTING DEVICE AND IMAGE FORMING APPARATUS INCLUDING THE SAME

INCORPORATION BY REFERENCE

This application is based on and claims the benefit of priority from Japanese Patent application No. 2016-061371 filed on Mar. 25, 2016, which is incorporated by reference in its entirety.

BACKGROUND

The present disclosure relates to a waste toner collecting device which collects a waste toner including a toner removed by a cleaning device and a scattered toner, and an image forming apparatus including the waste toner collecting device.

In an electrophotographic type image forming apparatus, such as a copying machine, a printer and a facsimile, a powder developer is mainly used. A latent image formed on an image carrier such as a photosensitive drum is visualized into a toner image with the developer (a toner) supplied from a developing device. The toner image is transferred on a sheet directly or via an image carrier such as an intermediate transferring belt, and then fixed on the sheet. The toner remained on the image carrier after the transferring is removed by a cleaning device, conveyed to a waste toner collection container by a conveying member such as a conveying screw to be collected.

On the other hand, when the latent image is visualized into the toner image by the developing device, some of the toner may be scattered, leaked out from the developing device and contaminate an inside of the image forming apparatus. Thereby, the image forming apparatus is sometimes provided with a floating toner collection container. In such a floating toner collection container, air including the scattered toner in the developing device (hereinafter, called as a floating toner) is sucked by a suction device, the floating toner is separated from the air and then collected.

However, in many cases, the floating toner collection container is provided separately from the waste toner collection container in which the waste toner removed from the image carrier by the cleaning device is collected. Thereby, if each container is filled with the collected toner, it is necessary to replace the floating toner collection container and the waste toner collection container separately, and a replacement work may be performed frequently. In addition, it is necessary to secure space where the floating toner collection container and the waste toner collection container are disposed, and thus the image forming apparatus may become large in size.

To solve the above problems, a suction path through which the floating toner is sucked may be provided in the waste toner collection container. In this case, although a space saving of the image forming apparatus becomes possible, because the toner collected in the waste toner collection container is also sucked through the suction path, suction force of the floating toner is lowered, and the floating toner cannot be efficiently removed.

SUMMARY

In accordance with an aspect of the present disclosure, a waste toner collecting device includes an intermediate collection box, a waste toner collection container, a conveying path, a conveying screw, an exhaust path and a floating toner collection chamber. The intermediate collection box stores a toner removed from an image carrier by a cleaning device. In the waste toner collection container, the toner stored in the intermediate collection box is collected. The conveying path is formed on a bottom face of the intermediate collection box. The conveying screw is supported in the conveying path so as to be rotatable in a normal direction and in a reverse direction. The conveying screw conveys the stored toner toward the waste toner collection container by rotating in the normal direction. Through the exhaust path, air containing a floating toner is sucked and passed. The floating toner collection chamber is provided on a part of the exhaust path and stores the floating toner separated from the air. The floating toner collection chamber is provided in the intermediate collection box. The floating toner collection chamber has a discharge opening and a discharge door. The discharge opening is opened to an inside of the intermediate collection box. The discharge door is interfered with the conveying screw as the conveying screw is rotated. The discharge door is turned between a storage position where the discharge opening is closed and a discharge position where the discharge opening is opened. Rotation of the conveying screw in the normal direction turns the discharge door into the storage position. Rotation of the conveying screw in the reverse direction turns the discharge door into the discharge position so that the floating toner stored in the floating toner collection chamber is discharged in the conveying path through the discharge opening.

In accordance with an aspect of the present disclosure, an image forming apparatus includes a developing device, a cleaning device and the above described waste toner collecting device. The developing device forms a toner image on an image carrier. The cleaning device removes the toner on the image carrier.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a waste toner collecting device 40 and an image forming apparatus 100 according to an embodiment of the present disclosure will be described.

Figure 1:
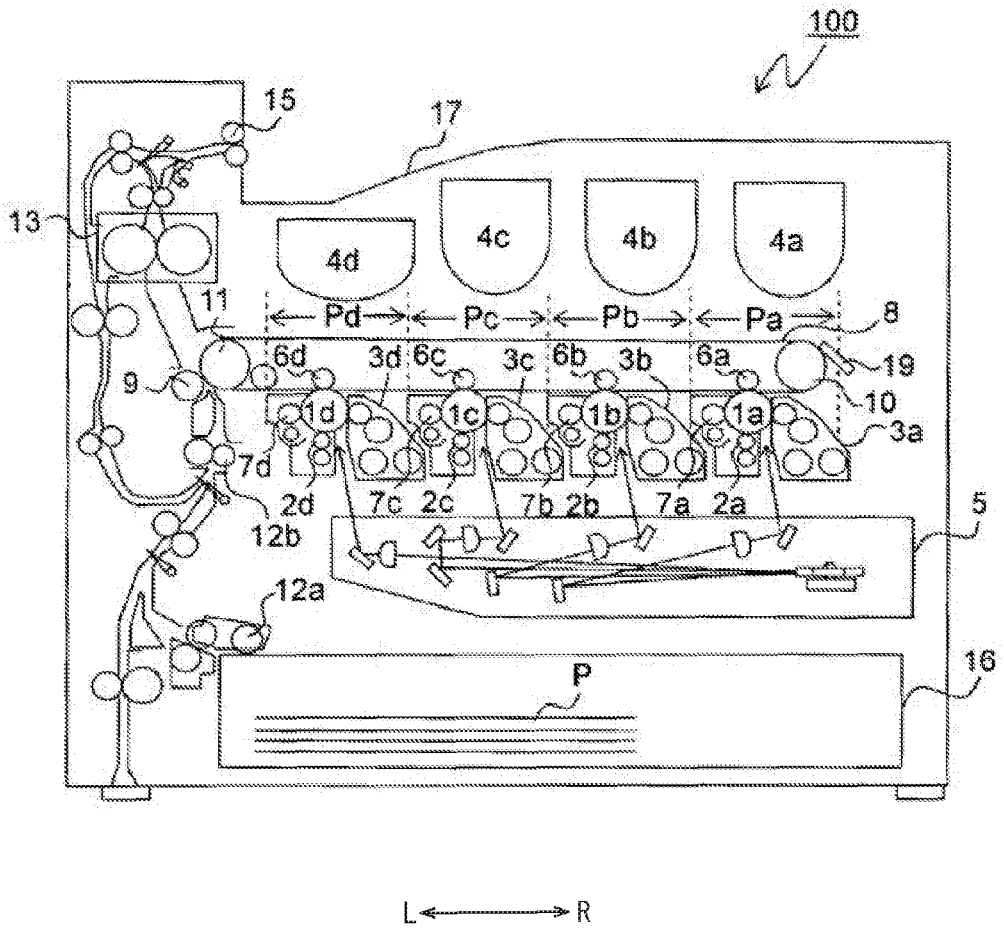
FIG. 1 is a front view showing a structure of an image forming apparatus according to an embodiment of the present disclosure.
Figure 2:
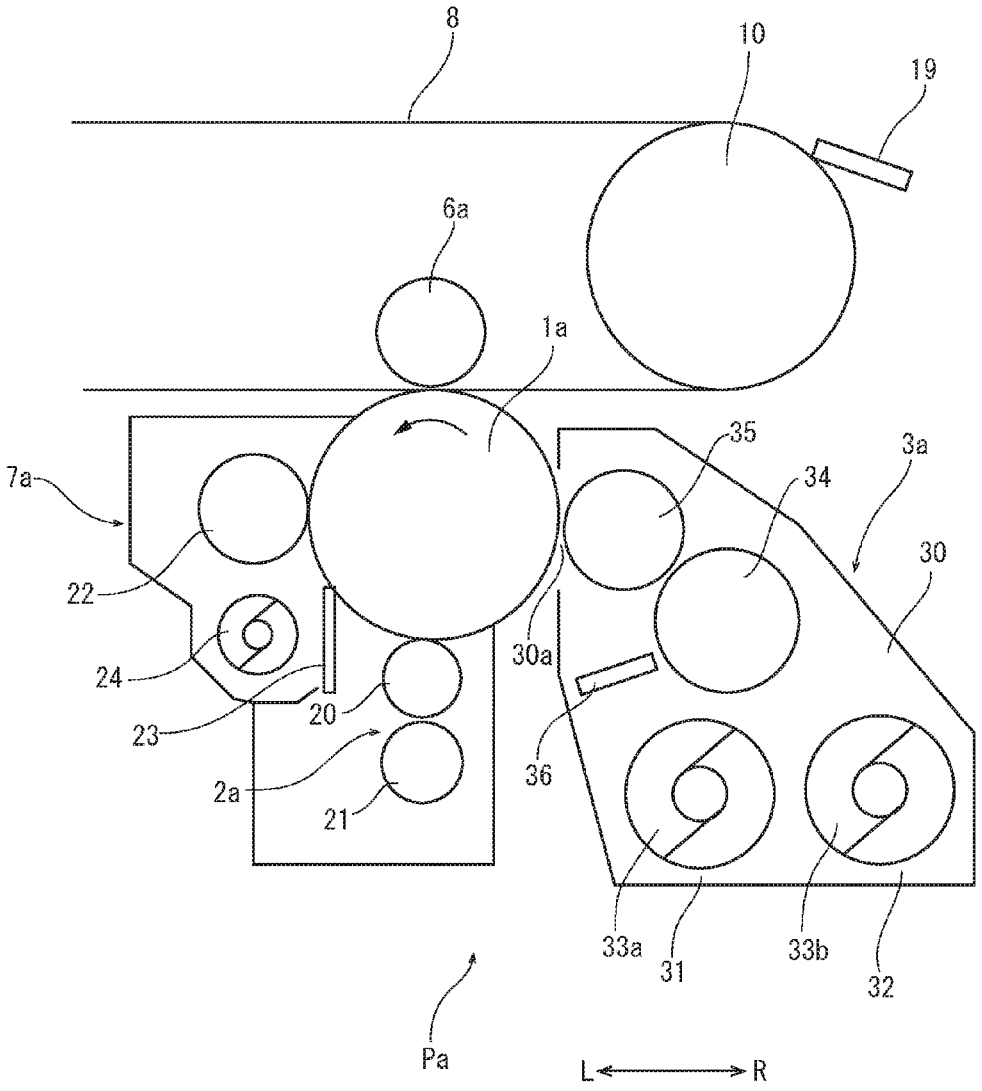
FIG. 2 is a front view showing an image forming part of the image forming apparatus according to the embodiment of the present disclosure.

With reference to FIGS. 1 and 2, the image forming apparatus 100 according to an embodiment of the present disclosure will be described. FIG. 1 is a front view showing a structure of the image forming apparatus 100 and FIG. 2 is a sectional view showing an image forming part Pa. The image forming apparatus 100 of the embodiment is a quadruple tandem type color printer including four image forming parts Pa, Pb, Pc and Pd which are adjacently arranged and form a full color image. The four image forming parts Pa, Pb, Pc and Pd respectively correspond to four different colors (magenta, cyan, yellow and black). In the following description, a front side of a paper plan of FIG. 1 shows a front side of the image forming apparatus 100, and left and right directions are based on a direction in which the image forming apparatus 100 is seen from the front side. Fr, Rr, L and R in each figure respectively show a front side, a rear side, a left side and a right side.

In an apparatus main body of the image forming apparatus 100, the four image forming parts Pa to Pd are adjacently arranged in the order from the right side of FIG. 1. These image forming parts Pa to Pd sequentially form images of magenta, cyan, yellow and black by a charging process, an exposing process, a developing process and a transferring process.

In these image forming parts Pa to Pd, photosensitive drums 1*a*, 1*b*, 1*c* and 1*d* are respectively provided so as to be rotatable in the counterclockwise direction in FIG. 1. The photosensitive drums 1*a* to 1*d* are image carries each of which carries a visible image (a toner image) of each color. Above the photosensitive drums 1*a* to 1*d*, an intermediate transferring belt 8 is bridged between a driven roller 10 and a driving roller 11. The intermediate transferring belt 8 is an image carrier which carries a visible image (a toner image) formed by overlapping the visible image of each color. The intermediate transferring belt 8 rotates in the clockwise direction at the same linier velocity as that of the photosensitive drums la to ld. In an inner hollow space of the intermediate transferring belt 8, first transferring rollers 6*a*, 6*b*, 6*c* and 6*d* are rotatably supported. The first transferring rollers 6*a* to 6*d* respectively oppose to the photosensitive drums 1*a* to 1*d* via the intermediate transferring belt 8. On the left side of the driving roller 11, a secondary transferring roller 9 is rotatably supported. The secondary transferring roller 9 opposes to the driving roller 11 via the intermediate transferring belt 8.

On a downstream side of the secondary transferring roller 9 in a rotation direction of the intermediate transferring belt 8 (near the driven roller 10), a belt cleaning device 19 is disposed. The belt cleaning device 19 removes the toner and the others remained on a surface of the intermediate transferring belt 8. The belt cleaning device 19 has a blade and a collection part. The blade comes into contact with the intermediate transferring belt 8 from a counter direction to the rotation direction of the intermediate transferring belt 8. The toner removed by the blade is collected in the collection part. The tonner collected in the collection part is conveyed toward the front side of the image forming apparatus 100 by a collection spiral. On a front face of the collection part, a discharge opening through which the conveyed toner is discharged is formed.

A sheet P on which the toner image is to be transferred is stored in a sheet feeding cassette 16 provided in a lower portion of the apparatus main body. The sheet P is conveyed to the secondary transferring roller 9 via a feed roller 12*a* and a registration roller pair 12*b*.

Next, the image forming parts Pa to Pd will be described. In the image forming parts Pa to Pd, charging devices 2*a*, 2*b*, 2*c* and 2*d*, developing devices 3*a*, 3*b*, 3*c* and 3*d* and drum cleaning devices 7*a*, 7*b*, 7*c* and 7*d* are respectively disposed around the photosensitive drums 1*a* to 1*d*. The charging devices 2*a* to 2*d* charge the photosensitive drums 1*a* to 1*d* respectively. The developing devices 3*a* to 3*d* develop latent images formed on the photosensitive drums 1*a* to 1*d* with the toner respectively. The drum cleaning devices 7*a* to 7*d* remove and collect the developer (the toner) remained on the photosensitive drums 1*a* to 1*d* respectively after the toner images are transferred. Below the image forming parts Pa to Pd, an exposing unit 5 is disposed. The exposing unit 5 performs exposing to the photosensitive drums 1*a* to 1*d* according to an image data.

Next, an image forming operation will be described. When the image data is input from a host apparatus such as a personal computer, the charging devices 2*a* to 2*d* respectively charge the surfaces of the photosensitive drums 1*a* to 1*d* uniformly, and then the exposing unit 5 performs the exposing to the photosensitive drums 1*a* to 1*d* according to the input image data to form latent images corresponding to the input image data on the photosensitive drums 1*a* to 1*d*. The latent images are developed by the developing devices 3*a* to 3*d* into toner images of corresponding colors. Then, by applying a predetermined transferring voltage between the first transferring rollers 6*a* to 6*d* and the photosensitive drums 1*a* to 1*d*, the toner images of magenta, cyan, yellow and black colors are first-transferred on the intermediate transferring belt 8. After that, in order to prepare for formation of next new latent images on the photosensitive drums 1*a* to 1*d*, the toner remained on the surfaces of the photosensitive drums 1*a* to 1*d* are removed by the drum cleaning devices 7*a* to 7*d* respectively. If a ratio of the toner to the two component developer filled in each of the developing devices 3*a* to 3*d* is lower than a predetermined value by the image forming operation described later, the toner is supplied to the developing devices 3*a* to 3*d* from toner containers 4*a* to 4*d* respectively.

The toner images formed on the photosensitive drums 1*a* to 1*d* are sequentially transferred on the intermediate transferring belt 8 which rotates in coming into contact with the photosensitive drums 1*a* to 1*d*. Then, a full color toner image is secondary-transferred on the sheet P by the secondary transferring roller 9. The full color toner image is heated and pressed at a fixing device 13 to be fixed on the sheet P. The sheet P on which the full color toner image has been fixed is ejected by an ejection roller pair 15 on the ejection tray 7.

With reference to FIG. 2, the image forming part Pa described above will be described in detail. The image forming parts Pb to Pd each have the substantially same structure as the image forming part Pa, and their detail descriptions are omitted. Around the photosensitive drum 1*a*, the charging device 2*a*, the developing device 3*a*, the first transferring roller 6*a* and the cleaning device 7*a* described above are arranged along a rotation direction of the photosensitive drum 1*a* (the counterclockwise direction in FIG. 2).

The charging device 2*a* has a charging roller 20 and a cleaning roller 21. The charging roller 20 comes in contact with the surface of the photosensitive drum 1*a* and applies a charging voltage on photosensitive drum 1*a*. The cleaning roller 21 cleans the charging roller 20.

The drum cleaning device 7*a* has a rubbing roller 22, a cleaning blade 23 and a collection spiral 24. The rubbing roller 22 comes in pressure contact with the photosensitive drum 1*a* at a predetermined pressure.

The cleaning blade 23 is supported on a downstream side of the contact portion of the rubbing roller 22 and the photosensitive drum 1*a* in the rotation direction of the photosensitive drum 1*a*, and comes in contact with the photosensitive drum 1*a* from a counter direction to the rotation direction of the photosensitive drum 1*a*.

The collection spiral 24 conveys the toner removed from the surface of the photosensitive drum 1*a* by the rubbing roller 22 and the cleaning blade 23 to the front side of the image forming apparatus 100. On a front face of the drum cleaning device 7*a*, a discharge opening through which the conveyed toner is discharged is formed.

Figure 3:
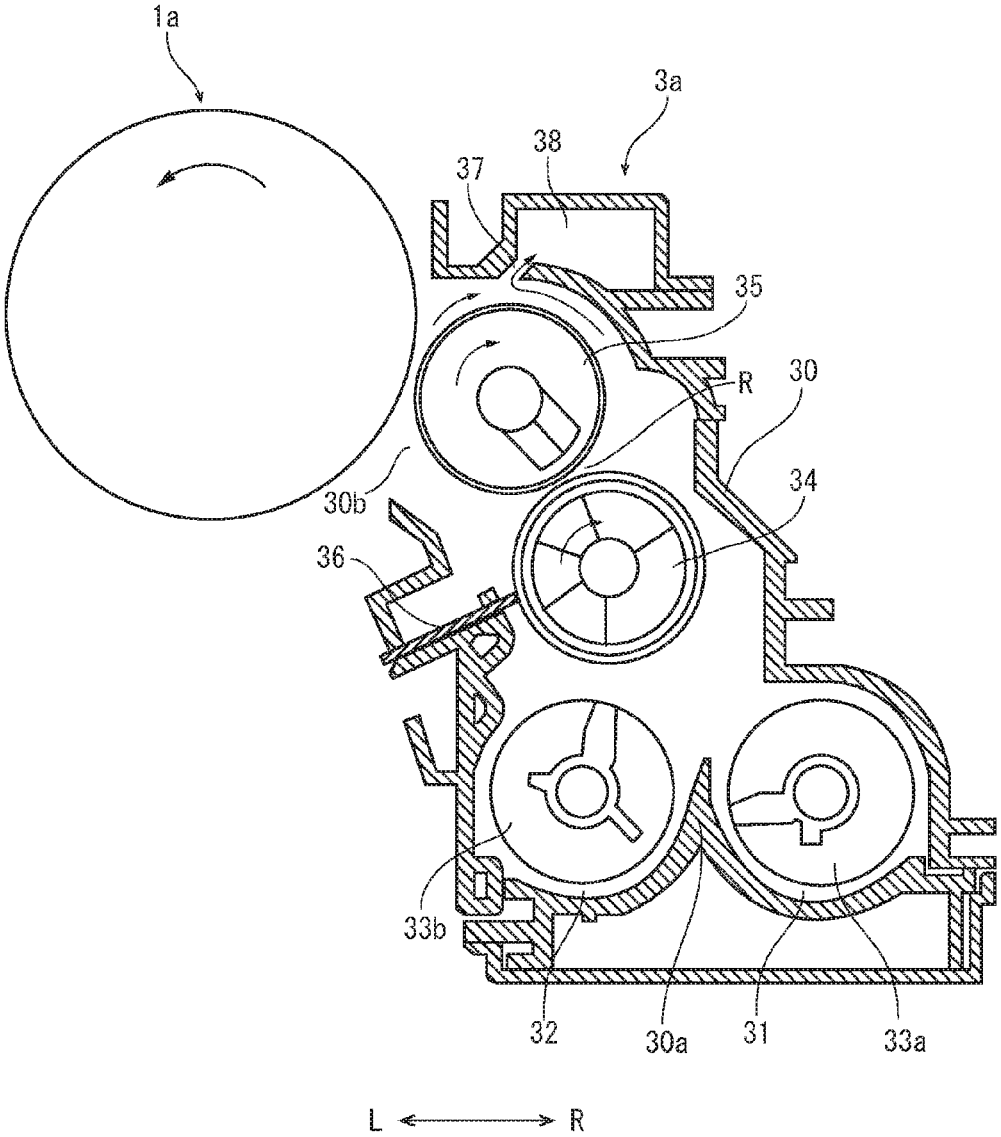
FIG. 3 is a front sectional view showing a structure of a developing device of the image forming apparatus according to the embodiment of the present disclosure.

Next, with reference to FIG. 3, the developing device 3*a* will be described. FIG. 3 is a sectional view showing a vicinity around the developing device 3*a*.

The developing device 3*a* has a development container 30 in which the two component developer containing a magnetic carrier and a toner (hereinafter, called as the developer) is contained. The development container 30 is divided by a partition wall 30*a* into an agitating/conveying chamber 31 and a supplying/conveying chamber 32. In the agitating/conveying chamber 31 and the supplying/conveying chamber 32, an agitating/conveying screw 33*a* and a supplying/conveying screw 33*b* are rotatably disposed respectively. The agitating/conveying screw 33*a* and the supplying/conveying screw 33*b* mix the toner supplied from the toner container 4*a* (refer to FIG. 1) with the magnetic carrier, agitate them and charge the toner.

In the agitating/conveying chamber 31 and the supplying/conveying chamber 32, the developer is agitated and conveyed by the agitating/conveying screw 33*a* and the supplying/conveying screw 33*b* in an axis direction of each screw (a perpendicular direction to the paper plan of FIG. 3). The developer circulates between the agitating/conveying chamber 31 and the supplying/conveying chamber 32 through developer passing paths (not shown) formed at both end portion of the partition wall 30*a*.

The development container 30 extends in the left upper oblique direction in FIG. 3. The development container 30 has an opening 30*b* formed at a portion opposing to the photosensitive drum 1*a*. In the development container 30, a magnetic roller 34 and a developing roller 35 are disposed. The magnetic roller 34 is positioned opposite to the supplying/conveying screw 33*b* in the vertical direction. The developing roller 35 is positioned opposite to the magnetic roller 34 in the left upper oblique direction. A part of an outer circumferential face of the developing roller 35 is exposed through the opening 30*b* and opposes to the photosensitive drum 1*a*. The magnetic roller 34 and the developing roller 35 are rotated in the clockwise direction in FIG. 3.

On an upstream side of the opposing area R of the developing roller 35 and the magnetic roller 34 in a rotation direction of the magnetic roller 34, a regulating blade 36 is attached along a length direction of the magnetic roller 34 (a perpendicular direction to the paper plan of FIG. 3). Between a tip edge of the regulating blade 36 and an outer circumferential face of the magnetic roller 34, a small gap is formed.

As described above, the developer is agitated while circulating between the agitating/conveying chamber 31 and the supplying/conveying chamber 32 in the development container by the agitating/conveying screw 33*a* and the supplying/conveying screw 33*b*. This charges the toner. The developer containing the charged toner is conveyed to the magnetic roller 34 by the supplying/conveying screw 33*b* to form a magnetic brush around the magnetic roller 34. A thickness of the magnetic brush is regulated by the regulating blade 36. The magnetic brush of which the thickness has been regulated is conveyed to the opposing area R of the magnetic roller 34 and the developing roller 35. At the opposing area R, the magnetic brush forms a toner layer on the developing roller 35 by voltage difference between a DC voltage applied to the magnetic roller 34 and a DC voltage applied to the developing roller 35 and magnetic field generated by the magnetic roller 34.

The toner layer formed on the developing roller 35 is conveyed by the rotation of the developing roller 35 to an opposing area (a developing area) where the photosensitive drum 1*a* and the developing roller 35 are opposite to each other. Because the predetermined voltage is applied to the developing roller 35, the toner fries from the developing roller 35 to the photosensitive drum 1*a* owing to voltage difference between the developing roller 35 and the photosensitive drum 1*a*, and develops the latent image on the photosensitive drum 1*a*.

The development container 30 has a suction opening 37 on a downstream side of the opposing area of the photosensitive drum 1*a* and the developing roller 35 in the rotation direction of the developing roller 35. Into the suction opening 37, air containing a floating toner existing near the developing roller 35 is sucked. To the suction opening 37, a floating toner duct 38 is connected. The floating toner duct 38 extends to the front side of the image forming apparatus 100.

On a front end of the agitating/conveying chamber 31, a developer discharge opening (not shown) is formed. Through the developer discharge opening, an excessive developer produced in the agitating/conveying chamber 31 and the supplying/conveying chamber 32 as the result of supplying the developer is discharged.

The image forming apparatus 100 further includes a waste toner collecting device 40 which collects the toner removed by the drum cleaning devices 7*a* to 7*b*, the toner removed by the belt cleaning device 19, the floating toner existing near the developing rollers 35 of the developing devices 3*a* to 3*d* and the excessive developer in the developing devices 3*a* to 3*d*.

Figure 4:
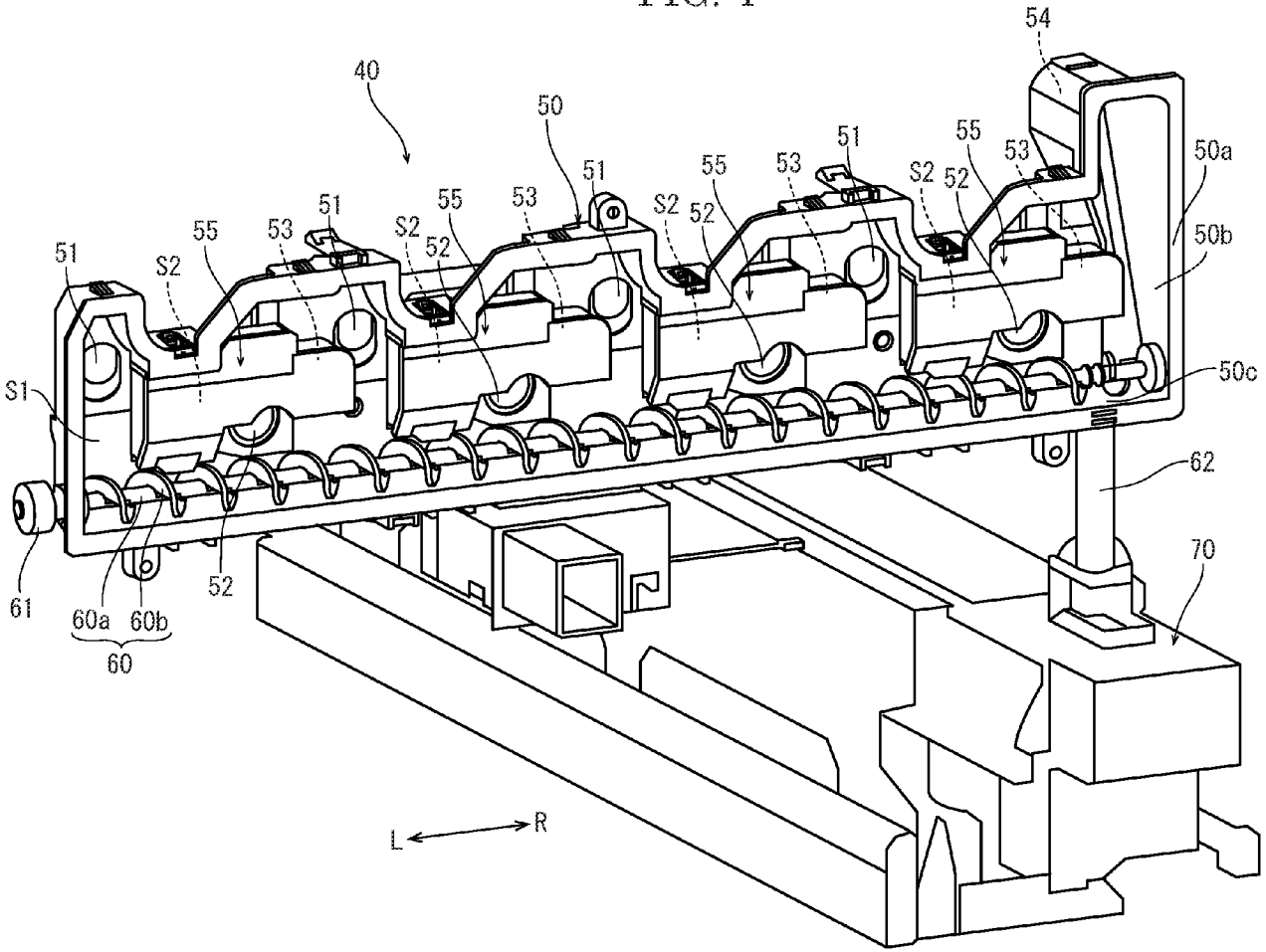
FIG. 4 is a front side perspective view showing a waste toner collecting device according to an embodiment of the present disclosure.
Figure 5:
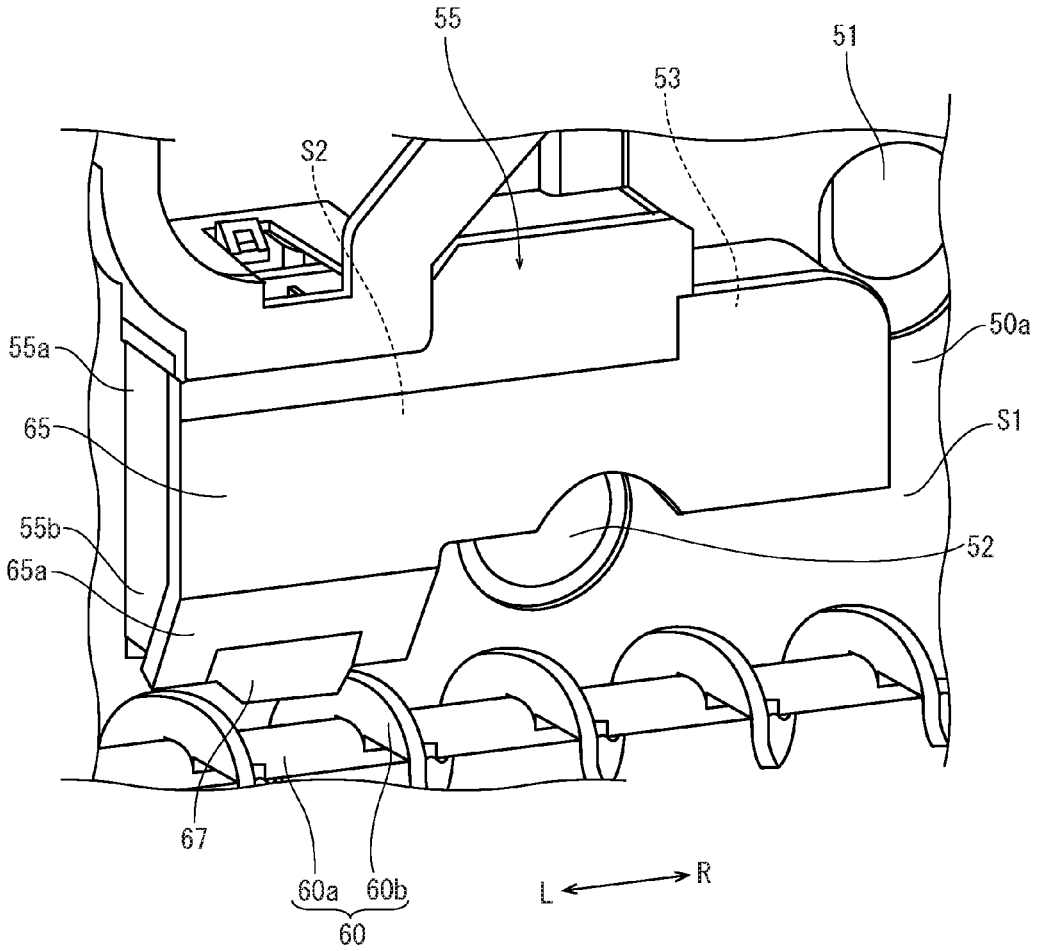
FIG. 5 is a front side perspective view showing a floating toner collection chamber in the waste toner collecting device according to the embodiment of the present disclosure.
Figure 6:
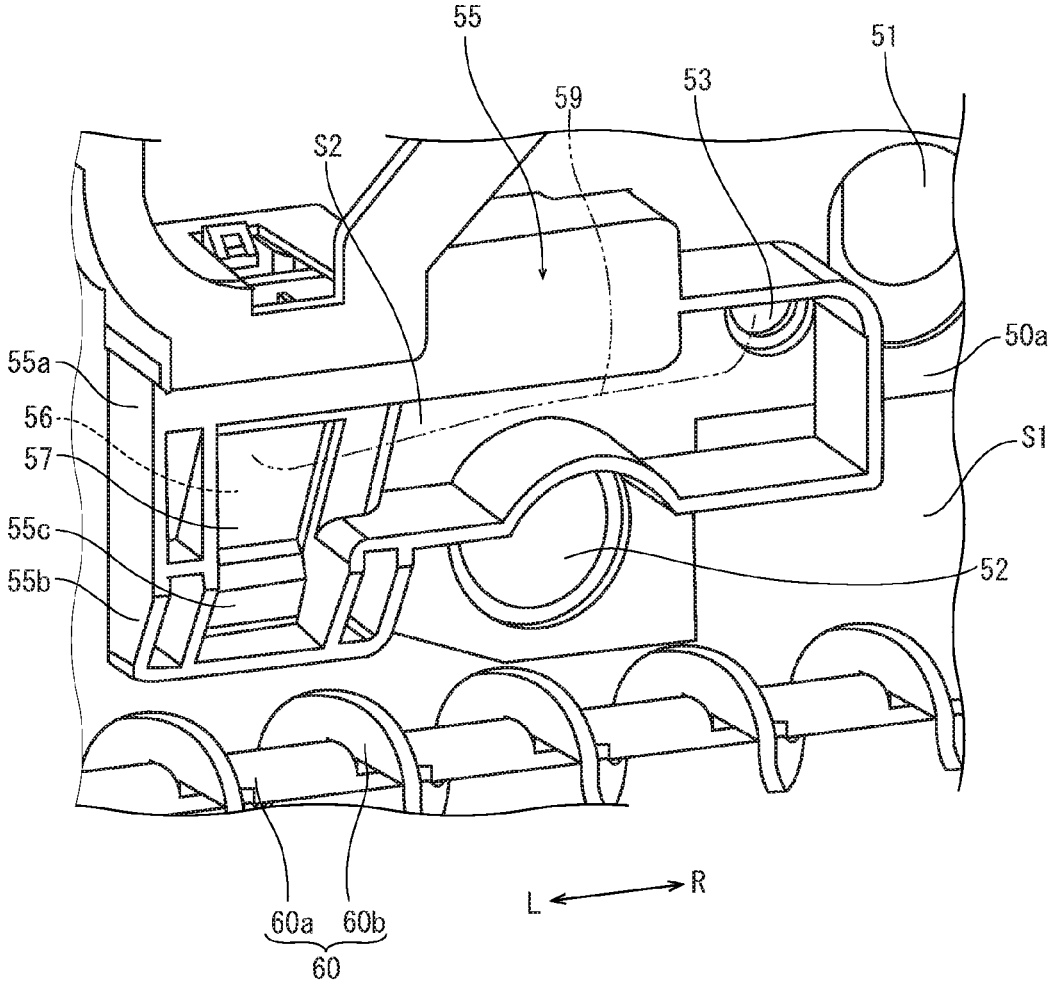
FIG. 6 is a front side perspective view showing an inside of the floating toner collection chamber in the waste toner collecting device according to the embodiment of the present disclosure.
Figure 7:
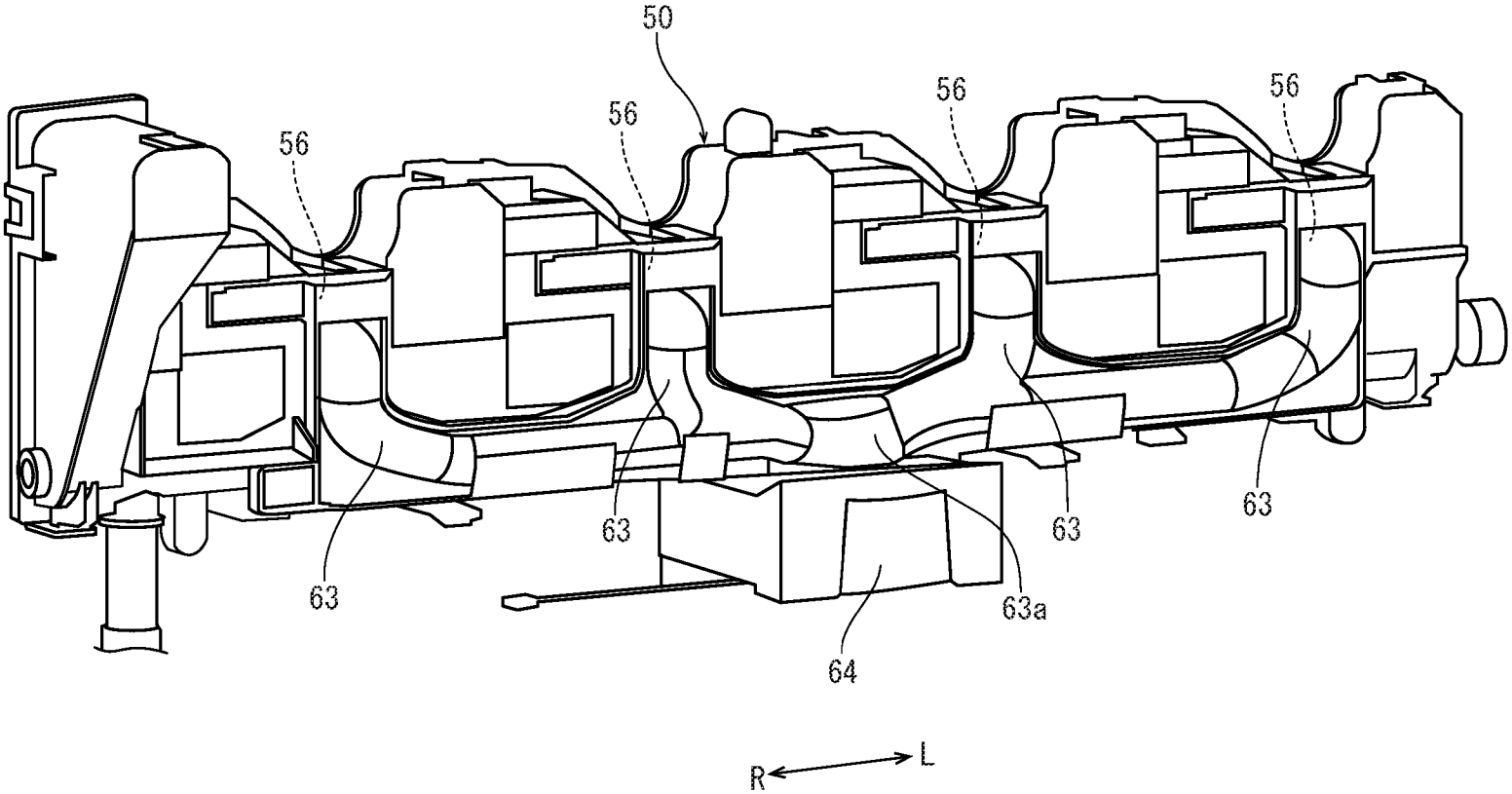
FIG. 7 is a rear side perspective view showing the waste toner collecting chamber according to the embodiment of the present disclosure.

With reference to FIGS. 4 to 7, the waste toner collecting device 40 will be described. FIG. 4 is a front side perspective view showing the waste toner collecting device 40. FIG. 5 is a front side perspective view showing a floating toner collection chamber 55. FIG. 6 is a front side perspective view showing an inside of the floating toner collection chamber 55. FIG. 7 is a rear side perspective view showing the waste toner collecting device 40.

The waste toner collecting device 40 includes an intermediate collection box 50, a waste toner collection container 70 and floating toner collection chambers 55. The intermediate collection box 50 is disposed on the front side of the image forming parts Pa to Pd. In the intermediate collection box 50, the removed toner is temporarily stored. The waste toner collection container 70 is disposed below the intermediate collection box 50. In the waste toner collection container 70, the removed toner is finally collected. The floating toner collection chambers 55 are provided inside of the intermediate collection box so as to correspond to the image forming parts Pa to Pd. In the floating toner collection chambers 55, the floating toner is temporarily stored.

As shown in FIG. 4, the intermediate collection box 50 has a width and a height respectively corresponding to a width and a height of the four image forming parts Pa to Pd, and a predetermined thickness. The intermediate collection box 50 has a base part 50*a* and a lid part 50*b* which forms a horizontally long parallelepiped hollow space S1. The base part 50*a* is formed with removed toner receiving openings 51 and floating toner receiving openings 53 (refer to FIG. 6 also). The removed toner receiving openings 51 are connected to the discharge openings of the drum cleaning devices 7*a* to 7*d*. The floating toner receiving openings 53 are connected to the floating toner ducts 38 of the developing devices 3*a* to 3*d*. The base part 50*a* is further formed with waste developer receiving openings 52 and a removed toner receiving opening 54. The waste developer receiving openings 52 are connected to the developer discharge openings of the developing devices 3*a* to 3*d*. The removed toner receiving opening 54 is connected to the discharge opening of the belt cleaning device 19.

On a bottom face of the intermediate collection box 50, a conveying path 50*c* is formed along the left and right directions. The toner and the developer received through the removed toner receiving openings 51 and 54 and the waste developer receiving openings 52 are fallen on the conveying path 50*c* by their own weight.

On the conveying path 50*c*, a conveying screw 60 is rotatably supported. The conveying screw 60 is a conveying member which conveys the stored toner. The conveying screw 60 has a rotating shaft 60*a* and a spiral blade 60*b*. The spiral blade 60*b* is spirally formed around the rotating shaft 60*a* in an axis direction of the rotating shaft 60*a* at constant pitches. To one end portion of the rotating shaft 60*a*, a gear 61 is fixedly attached. The gear 61 transmits rotation force from a driving source (not shown) to the rotating shaft 60*a*. As the driving source, a motor which rotates the feed roller 12*a* may be used, for example. The motor has a clutch which allows the rotating shaft 60*a* to be rotated in a normal direction and a reverse direction.

At a right end portion of a bottom face of the conveying path 50*c*, a connection pipe 62 connected to the waste toner collection container 70 is connected. On rotating in the normal direction, the conveying screw 60 conveys the toner and developer fallen on the conveying path 50*c* rightward in FIG. 4. The toner and developer is conveyed along the conveying path 50*c* and then collected into the waste toner collection container 70 through the connection pipe 62. The waste toner collection container 70 can be detachably attached to the connection pipe 62. The waste toner collection container 70 has a sensor which detects an amount of the collected toner and developer. When the sensor detects that a predetermined amount of toner and developer is collected, the waste toner collection container 70 is detached from the connection pipe 62 and the collected toner and developer is discarded.

As shown in FIGS. 5 and 6, the floating toner collection chamber 55 has a partition wall 55*a* and a lid part 65. The partition wall 55*a* is stood on the base part 50*a* so as to surround an area containing the floating toner receiving opening 53. The lid part 65 covers a space surrounded by the partition wall 55*a*. The partition wall 55*a*, the lid part 65 and the base part 50*a* form a horizontally long parallelepiped hollow space S2. The hollow space S2 is isolated from the hollow space S1 of the intermediate collection box 50. The floating toner receiving opening 53 is positioned at a right end portion of the floating toner collection chamber 55.

As shown in FIG. 6, at a left end portion of the floating toner collection chamber 55, an exhaust opening 56 is formed on the base part 50*a*. Through the exhaust opening 56, the hollow space S2 is evacuated. On the exhaust opening 56, an air filter 57 is attached with an obliquely downward posture. The air filter 57 blocks passing of the toner but allows passing of air.

As shown in FIG. 7, on a rear face of the base part 50*a*, an exhaust duct 63 is connected to each exhaust opening 56. The exhaust ducts 63 are joined to a center of the base part 50*a* in the left and right directions. On a joint portion 63*a* to which the exhaust ducts 63 are joined, an exhaust fan 64 is disposed. In this way, the floating toner duct 38 of each of the developing devices 3*a* to 3*d*, the floating toner collection chamber 55 and the exhaust duct 63 form an exhaust path 59 through which the air containing the floating toner existing near the developing roller 35 of each of the developing devices 3*a* to 3*d* is passed. That is, the floating toner collection chamber 55 forms a middle portion extending from the floating toner receiving opening 53 to the exhaust opening 56 between the floating toner duct 38 and the exhaust duct 63 in the exhaust path 59.

When the exhaust fan 64 is driven, pressure inside of each exhaust duct 63 becomes negative, and pressure inside of each floating toner collection chamber 55 and each floating toner dust 38 become also negative. As a result, the air containing the floating toner existing near each developing roller 35 of the developing devices 3*a* to 3*d* is sucked through the floating toner duct 38 into the floating toner collection chamber 55. In the floating toner collection chamber 55, the floating toner contained in the sucked air is collected by the air filter 57 and then stored in the floating toner collection chamber 55. On the other hand, the air is passed through the exhaust duct 63 and then discharged outside by the exhaust fan 64.

As shown in FIGS. 5 and 6, the partition wall 55*a* of the floating toner collection chamber 55 is formed with a protruded portion 55*b* such that the hollow space S2 of the floating toner collection chamber 55 extends downward from below the air filter 57. At a lower corner of the protruded portion 55*b*, a discharge opening 55*c* opened in an oblique lower direction is formed. The discharge opening 55*c* is opened and closed by a discharge door 65*a*, as shown in FIG. 5.

Figure 8:
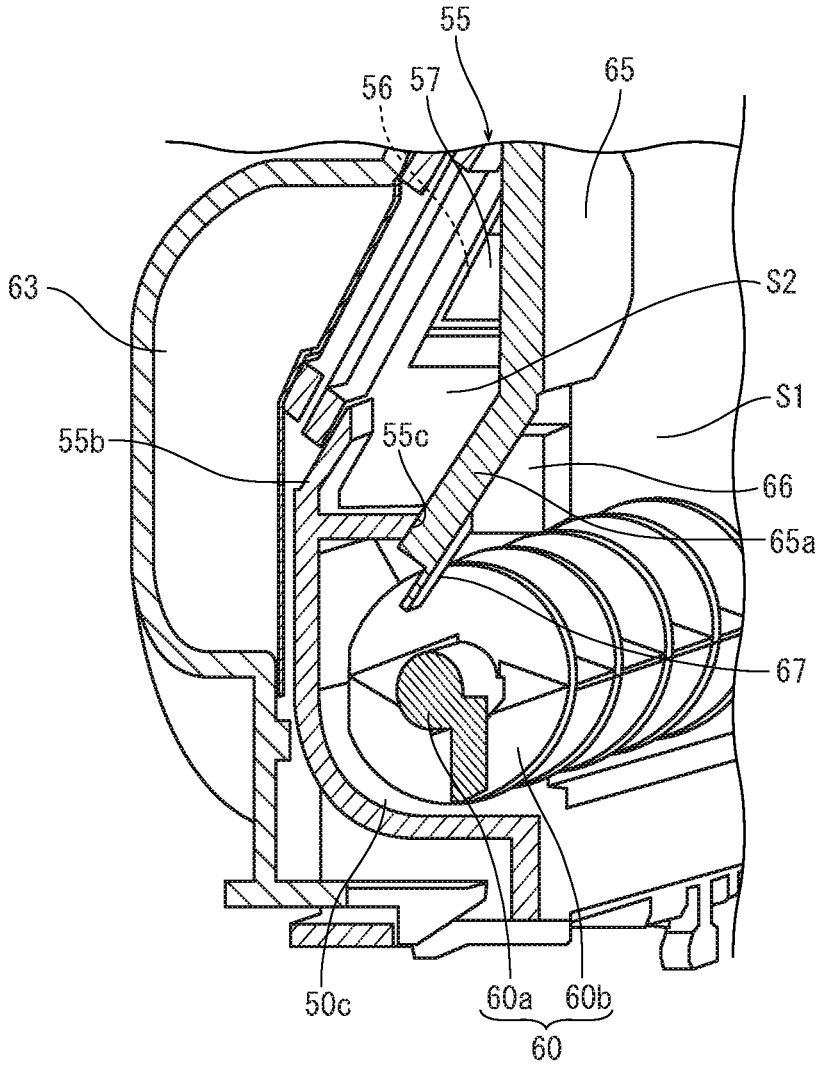
FIG. 8 is a sectional perspective view showing the floating toner collection chamber of which a discharge opening is closed with a discharge door, in the waste toner collecting device according to the embodiment of the present disclosure.
Figure 9:
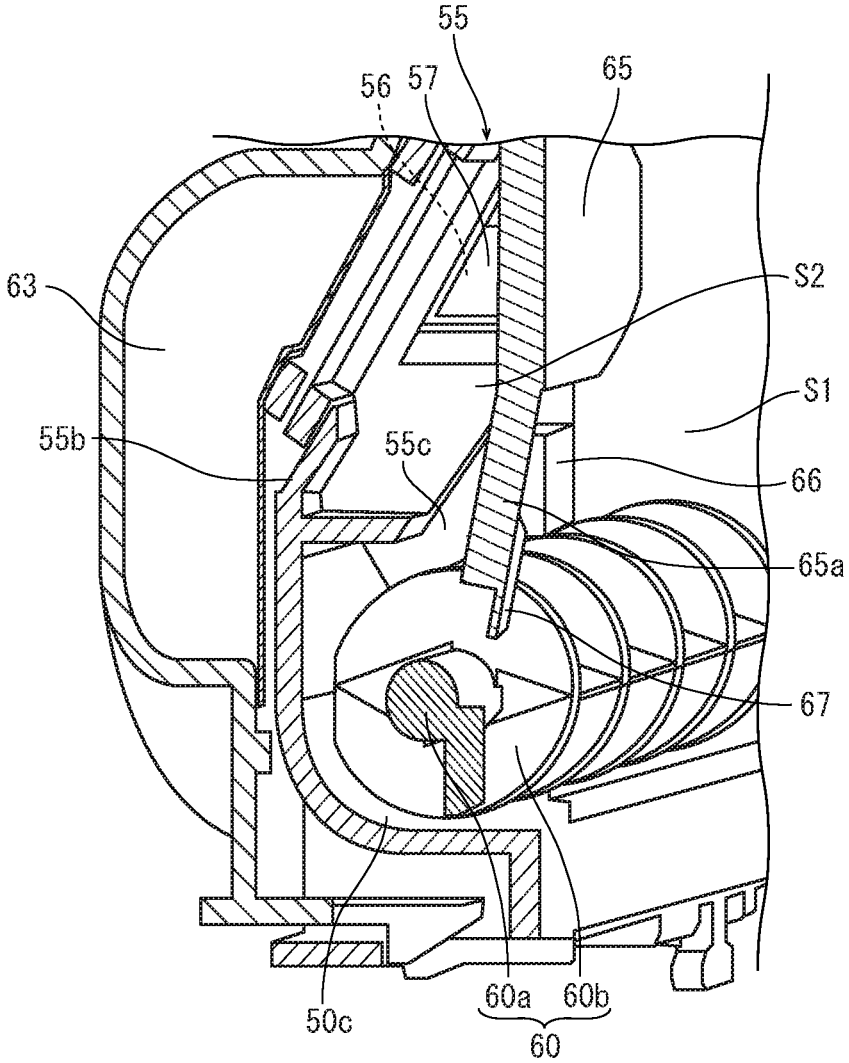
FIG. 9 is a sectional perspective view showing the floating toner collection chamber of which the discharge opening is opened with the discharge door, in the waste toner collecting device according to the embodiment of the present disclosure.
Figure 10:
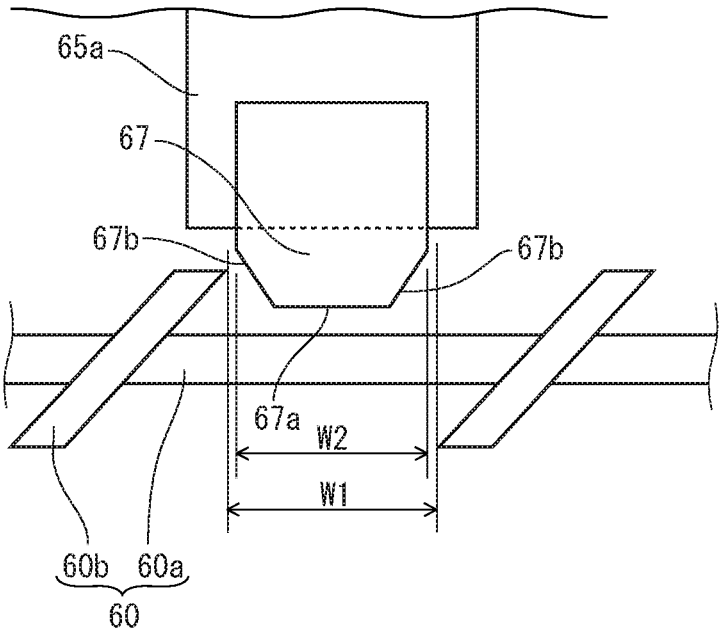
FIG. 10 is a front view showing a protruding piece and a spiral blade, in the waste toner collecting device according to the embodiment of the present disclosure.

With reference to FIGS. 8 to 10, the discharge door 65*a* will be described. FIG. 8 is a sectional perspective view showing the discharge opening 55*c* closed by the discharge door 65*a*. FIG. 9 is a sectional perspective view showing the discharge opening 55*c* opened by the discharge door 65*a*. FIG. 10 is a front view showing a protruding piece 67 and the spiral blade 60*b*.

The discharge door 65*a* is connected to the lid part 65, and turned between a storage position (refer to FIG. 8) and a discharge position (refer to FIG. 9) around an axis approximately parallel to the rotating shaft 60*a* of the conveying screw 60. In the storage position, the discharge door 65*a* closes the discharge opening 55*c*. In the discharge position, the discharge door 65*a* is turned toward the hollow space S1 of the intermediate collection box 50 and opens the discharge opening 55*c*. As shown in FIG. 8, in the storage position, the discharge door 65*a* extends in an oblique lower direction from the lid part 65. As shown in FIG. 9, in the discharge position, the discharge door 65*a* extends from the lid part 65 downward toward the conveying screw 60 supported by the conveying path 50*c*. The discharge door 65*a* is biased by a biasing member 66 to the storage position. The biasing member 66 is made of elastic material, such as urethane foam, for example. The biasing member 66 is interposed between the lid part 50*b* of the intermediate collection box 50 and the discharge door 65*a*.

At a tip edge of the discharge door 65*a*, a protruding piece 67 is fixedly attached. As shown in FIG. 10, the protruding piece 67 is formed into a trapezoidal shape in a front view, and has a tip edge 67*a* and inclined side edges 67*b* inclined in a direction in which they are approaching each other toward the tip edge 67*a*. The protruding piece 67 is made of elastic material, such as PET film. The protruding pieces 67 has a width W2 narrower than a pitch W1 of the spiral blade 60*b* of the conveying screw 60, and extends in a space between the adjacent spiral blades 60*b* of the conveying screw 60.

Figure 11A:
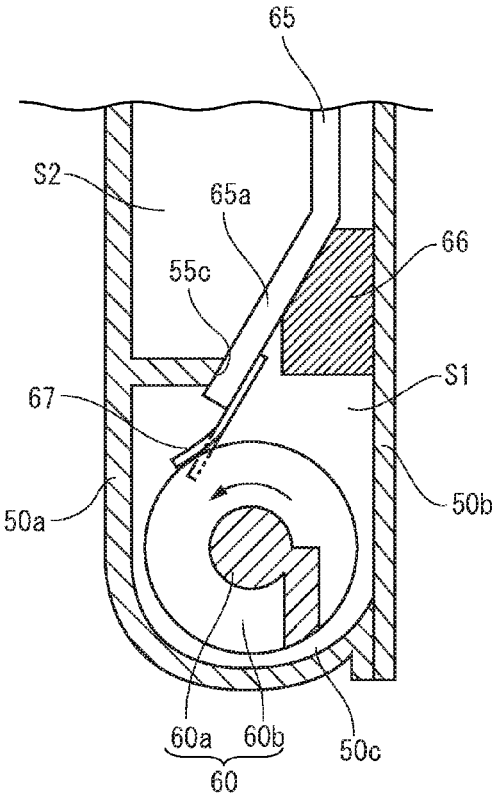
FIG. 11A is a side view showing the discharge door turned into a storage position, in the waste toner collecting device according to the embodiment of the present disclosure.
Figure 11B:
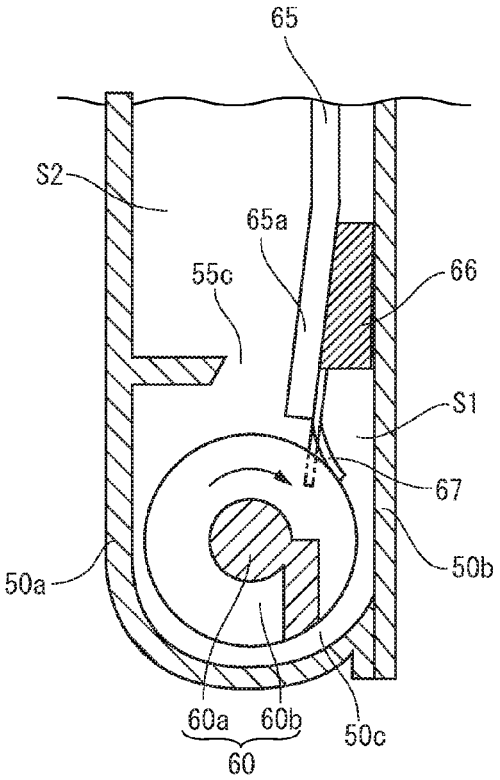
FIG. 11B is a side view showing the discharge door turned into a discharge position, in the waste toner collecting device according to the embodiment of the present disclosure.
Figure 12A:
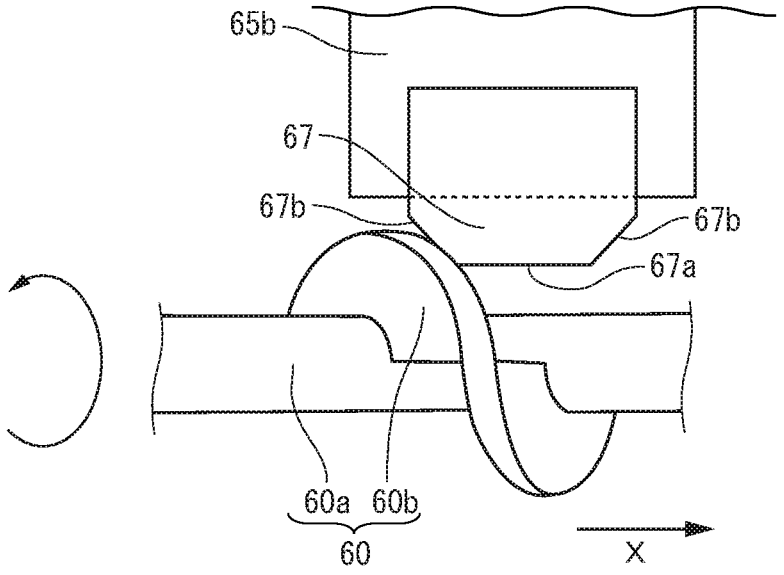
FIG. 12A is a front view showing the spiral blade coming into contact with an inclined edge of the protruding piece, in the waste toner collecting device according to the embodiment of the present disclosure.
Figure 12B:
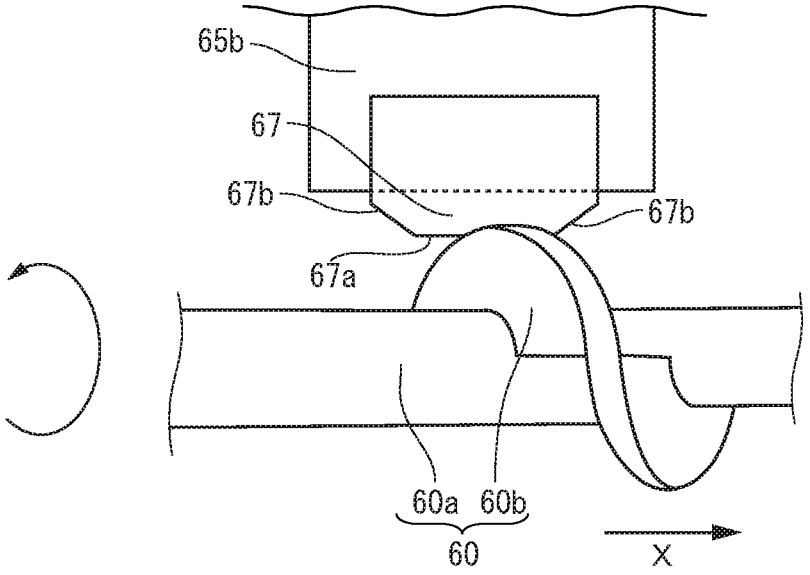
FIG. 12B is a front view showing the spiral blade coming into contact with a tip edge of the protruding piece, in the waste toner collecting device according to the embodiment of the present disclosure.

With reference to FIGS. 11A, 11*b*, 12A and 12B, a tuning operation of the discharge door 65*a* will be described. FIG. 11A is a side view showing the discharge door 65*a* turned to the storage position. FIG. 11B is a side view showing the discharge door 65*a* turned to the discharge position. FIG. 12A is a front view showing the spiral blade 60*b* coming into contact with the inclined edge 67*b* of the protruding piece 67. FIG. 12B is a front view showing the spiral blade 60*b* coming into contact with the tip edge 67*a* of the protruding piece 67.

As shown by a two-dotted line in FIG. 11A, in a state where the protruding piece 67 extends in the space between the adjacent spiral blades 60*b*, when the conveying screw 60 rotates in the normal direction (the counterclockwise direction in FIG. 11A) in order to convey the toner and developer fallen on the conveying path 50*c*, the spiral blade 60*b* comes in contact with the protruding piece 67. Then, as shown by a solid line in FIG. 11A, an outer circumferential face of the spiral blade 60*b* presses the protruding piece 67 in a rotation direction of the spiral blade 60*b* as the rotating shaft 60*a* rotates. By being pressed by the spiral blade 60*b*, the protruding piece 67 is deformed and bent with respect to the discharge door 65*a*.

When the spiral blade 60*b* comes into contact with the protruding piece 67, as shown in FIG. 12A, a corner between the outer circumferential face and a front side face of the spiral blade 60*b* in a conveying direction (X in FIGS. 12A and 12B) comes into contact with the inclined side edge 67*b* on a rear side in the conveying direction. Then, as shown in FIG. 12B, the outer circumferential face of the spiral blade 60*b* comes into contact with the tip edge 67*a* of the protruding piece 67 and presses the protruding piece 67 in the normal direction. Because the discharge door 65*a* is biased by the biasing member 66 to the storage position, the discharge door 65*a* is not largely turned by the conveying screw 60.

On the other hand, when the conveying screw 60 is rotated in the reverse direction, as shown in FIG. 11B, the protruding piece 67 is pressed in the reverse direction by the outer circumferential face of the spiral blade 60*b*, and the discharge door 65*a* is turned to the discharge position against biasing force of the biasing member 66. The turning operation of the discharge door 65*a* is a reverse operation to the turning operation in the case where the conveying screw 60 is rotated in the normal direction, and its detail description is omitted. When the discharge door 65*a* is turned to the discharge position, the floating toner stored in the floating toner collection chamber 55 is fallen on the conveying path 50*c* through the discharge opening 55*c*. When the rotation of the conveying screw 60 in the reverse direction is stopped, the discharge door 65*a* is biased by the biasing member 66 to the storage position so that the discharge opening 55*c* is closed.

A toner collecting operation of the waste toner collecting device 40 having the above described configuration will be described. During the image forming operation, as described above, the toner remained on the photosensitive drums 7*a* to 7*d* in the image forming parts Pa to Pd is removed by the drum cleaning devices 7*a* to 7*d*, respectively. The removed toner is temporarily stored in the intermediate collection box 50 through the removed toner receiving openings 51. In addition, the toner remained on the intermediate transferring belt 8 after the secondary transferring is removed by the belt cleaning device 19 and then temporarily stored in the intermediate collection box 50 through the removed toner receiving opening 54. Furthermore, the waste developer is temporarily stored in the intermediate collection box 50 through the waste developer receiving openings 52. The toner and waste developer received from the receiving openings is fallen on the conveying path 50*c* by their own weight.

In the conveying path 50*c*, the conveying screw 60 is driven by the driving source to be rotated in the normal direction and conveys the fallen toner and developer in the conveying direction (rightward). After being conveyed to a right end of the conveying path 50*c*, the toner and developer is then collected into the waste toner collection container 70 through the connection pipe 62.

On the other hand, when the exhaust fan 64 is driven at a suitable timing, the air containing the floating toner near the developing rollers 35 of the developing devices 3*a* to 3*d* is sucked into the exhaust path 59 including the floating toner ducts 38, the floating toner collection chambers 55 and the exhaust ducts 63. In the floating toner collection chamber 55 which is a part of the exhaust path 59, the toner is collected by the air filter 57. The collected toner is fallen by its own weight and accumulates on upper faces of the partition wall 55*a* and the discharge door 65*a*. On the other hand, the air passing through the air filter 57 is discharged outside through the exhaust duct 63 by the exhaust fan 64.

When an amount of the accumulated toner becomes a predetermined amount, the conveying screw 60 is made to be rotated in the reverse direction for a predetermined period. For instance, the conveying screw 60 is made to be rotated in the reverse direction for 2 to 3 seconds for every 1000 sheets. Then, the spiral blade 60*b* of the conveying screw 60 turns the discharge door 65*a* to the discharge position against the biasing force of the biasing member 66, as described above. Thereby, the discharge opening 55*c* is opened so that the floating toner accumulated on the upper faces of the discharge door 65*a* and the others is fallen on the conveying path 50*c*. The fallen toner is conveyed along the conveying path 50*c* by the conveying screw 60 together with the collected toner and developer, and collected into the waste toner collection container 70.

In the present embodiment, as described above, the floating toner collection chamber 55 in which the floating toner is temporarily stored is provided in the intermediate collection box 50 in which the toner removed by the drum cleaning devices 7*a* to 7*d* and the belt cleaning device 19 is temporarily stored. And, the floating toner stored in the floating toner collection chamber 55 can be discharged into the intermediate collection box 50. That is, it is not necessary to provide a floating toner collection container separately from the waste toner collection container 70. Accordingly, a number of replacement work of the collection containers can be reduces compared with a case where the floating toner collection container and the waste toner collection container 70 are separately provided so that the maintenance performance can be improved.

In addition, because it is not necessary to provide a floating toner collection container, enlargement in size of the image forming apparatus 100 can be inhibited. Furthermore, when a detecting sensor which detects the toner collection container being full is provided, only one of the detecting sensor is required so that a configuration of the waste toner collecting device can become simple and cost of it can be reduced.

In addition, the discharge door 65*a* is interfered with the spiral blade 60*c* as the conveying screw 60 is rotated, and turned to open and close the discharge opening 55*c* so that a dedicated tuning mechanism of the discharge door 65*a* for opening and closing the discharge opening 55*c* is not required. Accordingly, a configuration of the waste toner collecting device 40 can become simple.

In the embodiment, the protruding piece 67 of the discharge door 65*a* is pressed in the direction of the rotation direction of the spiral blade 60*b*. However, the protruding piece 67 may be pressed by the spiral blade 60*b* in the conveying direction and in an opposing direction to the conveying direction. In this case, the discharge door 65*a* may be supported so as to be rotatable around an axis perpendicular to the rotating shaft 60*a* of the conveying screw 60. And, the protruding piece 67 is made to be extended into a space between the spiral blades 60*b*. Thereby, when the rotating shaft 60*a* is rotated, a front side face or a rear side face of the spiral blade 60*b* in the conveying direction presses the protruding piece 67 in a front side direction or a rear side direction in the conveying direction to turn the discharge door 65*a* and to open or close the discharge opening 55*c*.

In addition, because the discharge door 65*a* of the floating toner collection chamber 55 is biased to the storage position by the biasing member 66, the discharge opening 55*c* is closed in a state where the conveying screw 60 is not rotated. Accordingly, when the exhaust fan 64 is driven to make the inside of the exhaust path 59 negative pressure, decrease in the suction force of the exhaust path 59 can be prevented.

In addition, use of the air filter 57 can separate the floating toner from the sucked air. Furthermore, because the discharge opening 55*c* is positioned below the air filter 57, the tonner collected by the air filter 57 can be fallen through the discharge opening 55*c* effectively.

The embodiment disclosed in this disclosure is considered to be illustrative in all points but to be restricted. The scope of the disclosure is shown by the scope of the claims not by the detailed description described above, and contains modification of or within an equivalent meanings of the scope of the claims. For instance, although the above embodiment was described in a case where configurations of the disclosure are applied to the color printer, the disclosure it not limited to the embodiment. The configurations of the disclosure may be applied to various image forming apparatus including a waste toner conveying path through which the waste toner is conveyed and an exhaust path through which the floating toner in the developing device is passed, such as a monochromatic printer, a monochromatic copying machine, a color copying machine, a multifunctional peripheral and a facsimile.

The invention claimed is:

1. A waste toner collecting device comprising:

an intermediate collection box in which a toner removed from an image carrier by a cleaning device is stored;

a waste toner collection container in which the toner stored in the intermediate collection box is collected;

a conveying path formed on a bottom face of the intermediate collection box;

a conveying screw supported in the conveying path so as to be rotatable in a normal direction and in a reverse direction, the conveying screw conveying the stored toner toward the waste toner collection container by rotating in the normal direction;

an exhaust path through which air containing a floating toner is sucked and passed; and a floating toner collection chamber provided on a part of the exhaust path and storing the floating toner separated from the air, wherein the floating toner collection chamber is provided in the intermediate collection box, and includes:

a discharge opening opened to an inside of the intermediate collection box; and a discharge door which is interfered with the conveying screw as the conveying screw is rotated, and is turned between a storage position where the discharge opening is closed and a discharge position where the discharge opening is opened, wherein rotation of the conveying screw in the normal direction turns the discharge door into the storage position and rotation of the conveying screw in the reverse direction turns the discharge door into the discharge position so that the floating toner stored in the floating toner collection chamber is discharged in the conveying path through the discharge opening.

2. The waste toner collecting device according to claim 1, further comprising a biasing member which bias the discharge door into the storage position.

3. The waste toner collecting device according to claim 1, wherein the conveying screw has a rotating shaft and a spiral blade provided around the rotating shaft spirally in an axis direction of the rotating shaft at constant pitches, the discharge door has a protruding piece protruding in a space between the adjacent spiral blades in the axis direction, wherein when the conveying screw is rotated in the normal direction, an outer circumferential face of the spiral blade presses the protruding piece in the normal direction to turn the discharge door toward the storage position, when the conveying screw is rotated in the reverse direction, the outer circumferential face of the spiral blade presses the protruding piece in the reverse direction to turn the discharge door toward the discharge position.

4. The waste toner collecting device according to claim 3, wherein the protruding piece has a trapezoidal shape having a tip edge and side edges inclined in a direction where they are approaching each other toward the tip edge.

5. The waste toner collecting device according to claim 1, wherein the exhaust path has:

a floating toner duct, one end thereof connecting to an inside of a developing device, the other end thereof connecting to the intermediate collection box; and an exhaust duct, one end thereof connecting to the intermediate collection box, the other end thereof connecting to a suction fan, the floating toner collection chamber forms the exhaust path between the floating toner duct and the exhaust duct.

6. The waste toner collecting device according to claim 5, wherein the intermediate collection box has:

a floating toner receiving opening connected to the other end of the floating toner duct; and an exhaust opening connected to the one end of the exhaust duct, the floating toner collection chamber has:

a partition wall surrounding the floating toner receiving opening and the exhaust opening; and a lid part closing a space surrounded by the partition wall, wherein the discharge opening is provided on the partition wall and the discharge door is connected to the lid part.

7. The waste toner collecting device according to claim 1, wherein the floating toner collection chamber has a filter which blocks passing of the floating toner and allows passing of air, the floating toner is separated from the air containing the floating toner by passing the air through the filter, collected by the filter and stored in the floating toner collection chamber.

8. The waste toner collecting device according to claim 7, wherein the discharge opening is disposed below the filter.

9. An image forming apparatus comprising:

a developing device which forms a toner image on an image carrier;

a cleaning device which removes the toner on the image carrier; and a waste toner collecting device according to claim 1.

* * * * *